United States Patent [19]

Nagasaka et al.

[11] Patent Number: 4,975,082

[45] Date of Patent: Dec. 4, 1990

[54] DOUBLE ENGAGEMENT STRUCTURE FOR TERMINAL AND CONNECTOR

[75] Inventors: Yasuhiro Nagasaka, Aichi; Masanori Tsuji; Takayuki Yamamoto, both of Shizuoka, Japan

[73] Assignee: Yazaki Corporation, Tokyo, Japan

[21] Appl. No.: 358,117

[22] Filed: May 30, 1989

[30] Foreign Application Priority Data

May 30, 1988 [JP] Japan ..... 63-70300[U]

[51] Int. Cl.[5] ..... H01R 13/424

[52] U.S. Cl. ..... 439/595; 439/598; 439/594

[58] Field of Search ..... 439/594, 595, 597–600

[56] References Cited

U.S. PATENT DOCUMENTS

| | | | |
|---|---|---|---|
| 4,557,542 | 12/1985 | Coller et al. | 439/595 |
| 4,565,416 | 1/1986 | Rudy et al. | 439/600 |
| 4,655,525 | 4/1987 | Hunt et al. | 439/599 |
| 4,714,437 | 12/1987 | Dyki | 439/595 |
| 4,721,482 | 1/1988 | Fukuda et al. | 439/595 |
| 4,758,182 | 7/1988 | Anbo et al. | 439/598 |
| 4,787,864 | 11/1988 | Hunt et al. | 439/595 |
| 4,806,123 | 2/1989 | Konishi et al. | 439/595 |
| 4,820,198 | 4/1989 | Lulko et al. | 439/599 |
| 4,900,271 | 2/1990 | Colleran et al. | 439/595 |
| 4,902,247 | 2/1990 | Suzuki et al. | 439/595 |
| 4,921,448 | 5/1990 | Endo et al. | 439/595 |

*Primary Examiner*—Paula A. Bradley

*Attorney, Agent, or Firm*—Armstrong, Nikaido, Marmelstein, Kubovcik & Murray

[57] ABSTRACT

When a locking holder is fitted with a receiving chamber of an insulator housing, and a terminal is completely inserted into the receiving chamber to reach a proper position where an opening in the terminal engages a flexible arm formed in the receiving chamber, a stopper projection of the terminal is disposed in registry with a stopper groove of a bar portion of the locking holder, and when the locking holder is moved from the proper position toward the terminal, the stopper groove of the bar portion of the locking holder is brought into engagement with the stopper projection of the terminal, thereby effecting double engagement of the terminal with both the flexible arm of the insulator housing and the bar portion of the locking holder, and simultaneously a final locking portion of the locking holder is finally locked to the insulator housing.

5 Claims, 4 Drawing Sheets

DOUBLE ENGAGEMENT STRUCTURE FOR TERMINAL AND CONNECTOR

BACKGROUND OF THE INVENTION

The present invention relates to a double engagement structure for a terminal in a connector.

As an engagement structure for preventing disengagement of a terminal in a connector for use in connection of wire harnesses or electrical equipments, there is disclosed in U.S. Pat. No. 3,686,619 a structure as shown in FIG. 6. Referring to FIG. 6, a flexible arm c having a stopper projection d is formed in a terminal receiving chamber b of an insulator housing a. The stopper projection d is engaged with a small-diameter portion f of a terminal e received in the receiving chamber b. A locking plate h is inserted into a slot g of the insulator housing a, so as to hinder flexing (displacement) of the flexible arm c.

However, in this structure, the engagement between the stopper projection d and the small-diameter f of the terminal e is weak, resulting in a small holding force being applied to the terminal e. Therefore, there is a possibility of the terminal e being disengaged from the insulator housing a when an electrical wire i connected to the terminal e is strongly pulled. Such a problem will cause a serious automobile accident particularly in motion.

SUMMARY OF THE INVENTION

It is an object of the present invention to provide a double engagement structure for a terminal and a connector which may reliably prevent disengagement of the terminal with an increased holding force.

It is another object of the present invention to provide a double engagement structure for a terminal and a connector which may prevent incomplete insertion of the terminal into a housing.

According to the present invention, there is provided a double engagement structure for a terminal and a connector comprising an insulator housing having a receiving chamber therein, said receiving chamber opening at first and second ends thereof; a terminal to be inserted through said first end into the receiving chamber of the insulator housing; means for providing a primary lock between said insulator housing and said terminal; a locking holder to be inserted through said second end into the receiving chamber of the insulator housing, said locking holder being adapted for first step engagement and second step engagement with said insulator housing; first secondary lock means formed in said terminal; and second secondary lock means formed in said locking holder; said first secondary lock means and said second secondary lock means being in registry with each other in a lateral direction in the first step engagement of the locking holder with said insulator housing only when said terminal is fully inserted into said receiving chamber of the insulator housing, whereby said locking holder is allowed to move laterally into said second step engagement with said insulator housing to provide a secondary lock between said insulator housing and said terminal by means of said first and second secondary lock means.

Other objects and features of the invention will be more fully understood from the following detailed description and appended claims when taken with the accompanying drawings.

DETAILED DESCRIPTION OF THE PREFERRED EMBODIMENTS

There will now be described a preferred embodiment of the present invention with reference to the drawings.

Figure 1:
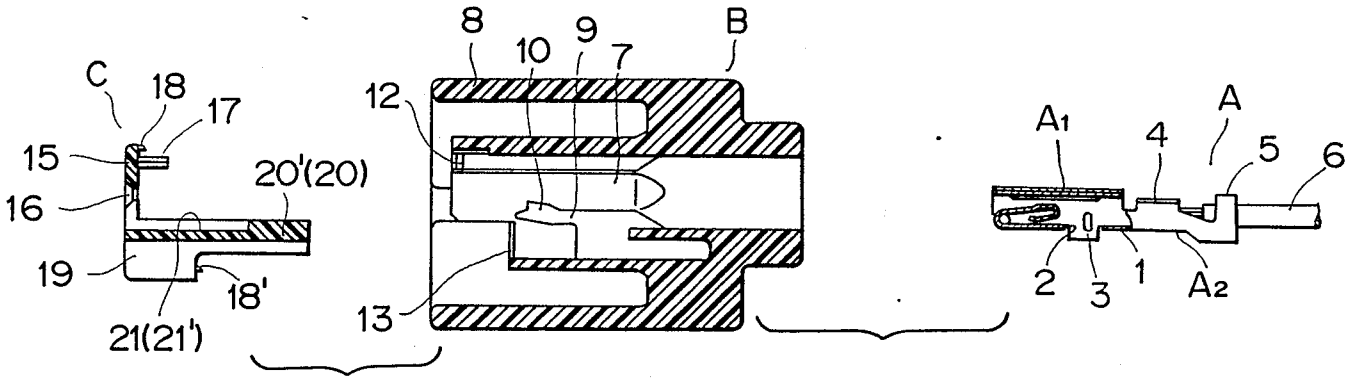
FIG. 1 is a vertical sectional view of the terminal, the insulator housing and the locking holder under a separate condition according to the present invention.
Figure 2:
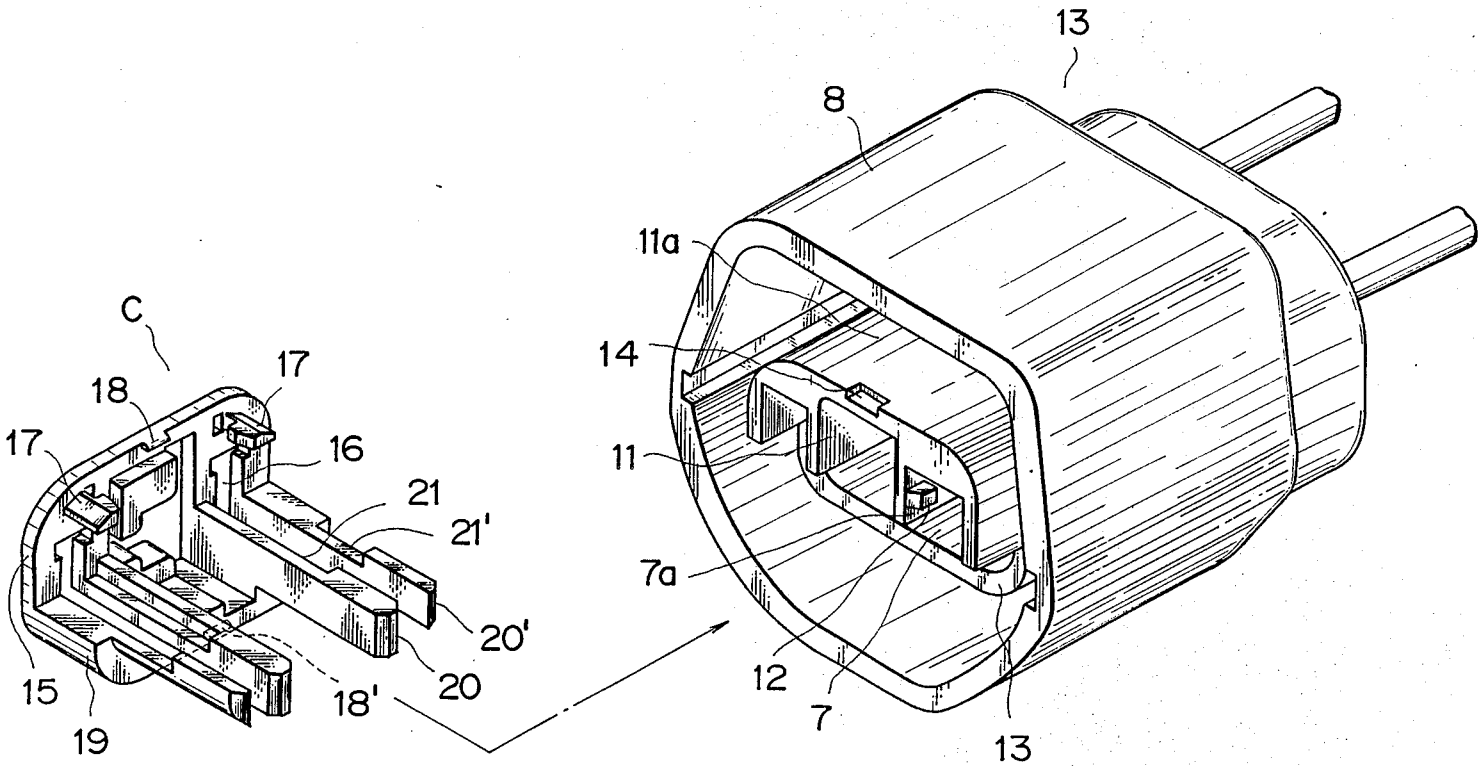
FIG. 2 is a perspective view of the insulator housing and the locking holder shown in FIG. 1.
Figure 3:
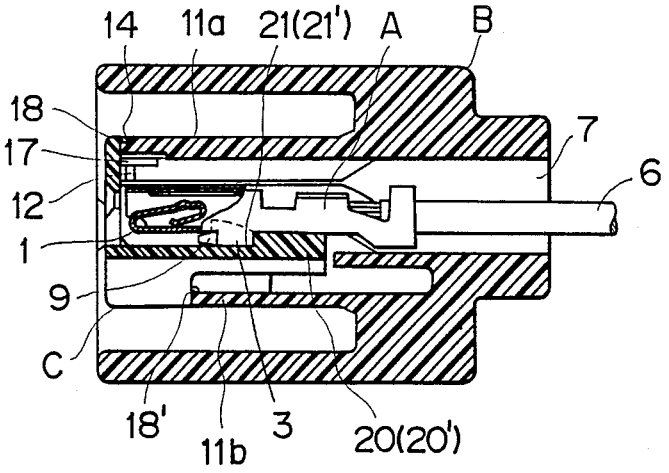
FIG. 3 is a vertical sectional view of the assembly of the terminal, the insulator housing and the locking holder under a final locked condition according to the present invention.

Referring to FIGS. 1 to 3, reference characters A, B and C designate a female terminal, an insulator housing and a locking holder respectively.

The female terminal A includes a base portion 1, an electrical contact portion $A_1$ formed on the forward side of the base portion 1 for engaging a male terminal (not shown), and a wire connecting portion $A_2$ formed on the rearward side of the base portion 1 for connecting an electrical wire 6. The base portion 1 is formed with an opening 2 and a pair of stopper projections 3 struck out of said base portion and projecting downwardly on opposite sides thereof. The electrical wire 6 is fixedly connected to the wire connecting portion $A_2$ in such a manner that a conductor of the wire 6 is clamped by a conductor clamping portion 4 and an insulator of the wire 6 is clamped by an insulator clamping portion 5.

The insulator housing B is formed with a pair of receiving chambers 7 for receiving a pair of female terminals A and with a hood 8 around the receiving chambers 7 as forming an outer wall of the housing B for receiving a mating connector (not shown). Each of the receiving chambers 7 is provided with a flexible arm 9 having a projection 10 adapted to engage the opening 2 of the female terminal A. A cavity portion 11 is formed between the receiving chambers 7. An inner wall **7*a* of each receiving chamber 7 is formed with a temporary locking portion 12 for temporarily locking the locking holder C to the insulator housing B. A lower half of each receiving chamber 7 is cut out to form a recessed portion 13. An upper wall 11*a* of the cavity portion 11 is formed with a final locking groove 14** for finally locking the locking holder C to the insulator housing B.

The locking holder C is generally constructed of a base 15 and a horizontal bottom portion 19 extending substantially perpendicularly to a lower end of the base 15. The base 15 is formed with a pair of holes 16 adapted to be communicated with the receiving chambers 7 for inserting a pair of male terminals (not shown). A pair of temporary locking projections 17 each having an L-shaped configuration are formed on an inside surface of the base 15 so as to engage the pair of temporary locking portions 12 formed in the receiving chambers 7, respectively. The base 15 is further formed with a final locking pawl 18 adapted to engage the final locking groove 14 of the insulator housing B. Similarly, the horizontal bottom portion 19 is formed at its inside end with another final locking pawl 18' adapted to engage a bottom wall 11*b* of the cavity portion 11 of the insulator housing B. Under the final locking condition, the horizontal bottom portion 19 is aligned to the recessed portion 13. The horizontal bottom portion 19 is formed on its upper surface with a pair of groups of bars 20 and 20' extending horizontally from the inside surface of the base 15 and projecting from the inside end of the horizontal bottom portion 19. The bars 20 and 20' of each group extend in substantially parallel to each other, and are adapted to be inserted into each receiving chamber 7. The bars 20 and 20' are formed in their upper surfaces with stopper grooves 21 and 21', respectively, for engaging the pair of stopper projections 3 of each female terminal A.

Figure 4:
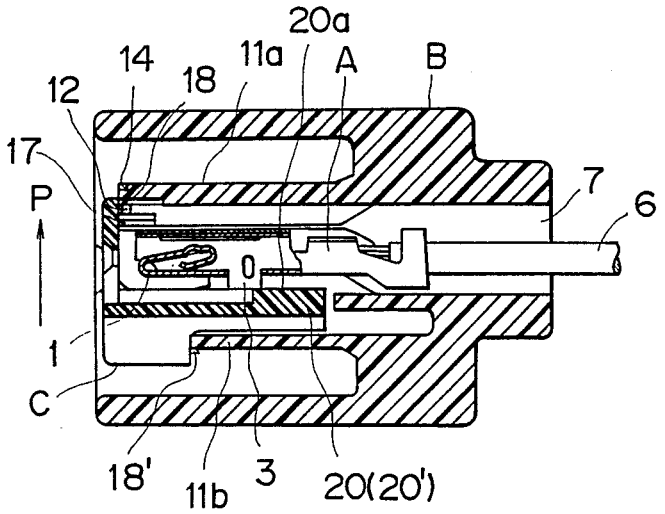
FIGS. 4 and 5 are views similar to FIG. 3, illustrating incomplete insertion of the terminal.
Figure 5:
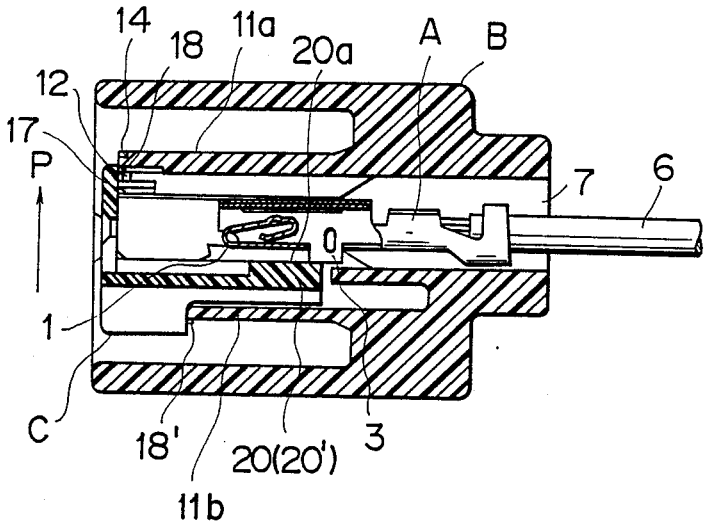
Figure 6:
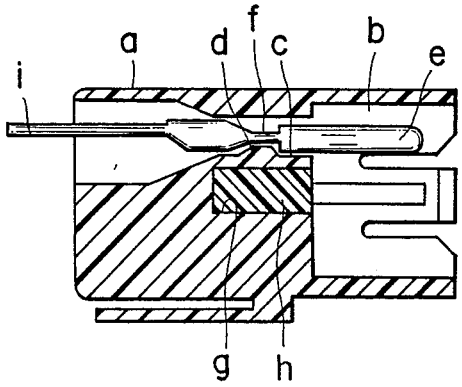
FIG. 6 PRIOR ART
FIG. 6 is a vertical sectional view of the stopper structure in the prior art.

In operation, the locking holder C is engaged into the insulator housing B in the first step such that the two pairs of bars 20 and 20' are inserted into the receiving chambers 7, and the temporary locking projections 17 are brought into engagement with the temporary locking portions 12, thus temporarily locking the locking holder C to the insulator housing B as shown in FIGS. 4 and 5.

Then, each female terminal A is inserted into the corresponding receiving chamber 7 from the rear open end thereof until it reaches a proper position where the opening 2 of the female terminal A is brought into engagement with the projection 10 of the flexible arm 9 of the insulator housing B. In the proper position of the female terminal A, the stopper projections 3 of the female terminal A is located in registry with the stopper grooves 21 and 21' of the bars 20 and 20' in a lateral direction. Then, the locking holder C is vertically moved while being guided by the temporary locking portion 12 and the temporary projections 17 as shown by an arrow P in FIGS. 4 and 5 to thereby engage the stopper grooves 21 and 20' with the stopper projections 3 to ensure the double engagement between the terminal 3 and the connection housing B. At the same time, the final locking pawls 18 and 18 of the locking holder C are brought into engagement with the final locking groove 14 and the inner wall 11*b* of the insulator housing B, respectively, to perform a second step engagement with the insulator housing. Thus, each female terminal A is prevented from being pulled off owing to the double engagement with both the flexible arm 9 of the insulator housing B and the bars 20 and 21' of the locking holder C. Furthermore, the locking holder C is locked to the insulator housing B by the final locking pawls 18 and 18'.

If the female terminal A is incompletely inserted into the receiving chamber 7 as shown in FIGS. 4 and 5, the stopper projections 3 of the female terminal A are in contact with upper surfaces 20*a* of the bars 20 and 20'. Accordingly, the locking holder C cannot be vertically moved in the direction of the arrow P, and it cannot be locked to the insulator housing B. Therefore, such incomplete insertion of the female terminal A can be prevented.

Although the double stopper structure as mentioned above is applied to the female terminal in the preferred embodiment, it may be similarly applied to a male terminal having a similar stopper.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A double engagement structure for a terminal and a connector comprising:

an insulator housing having a substantially elongated receiving chamber therein, said receiving chamber opening at first and second ends thereof;

a terminal to be inserted through said first end into the receiving chamber of the insulator housing;

means for providing a primary lock between said insulator housing and said terminal;

a locking holder to be inserted through said second end into the receiving chamber of the insulator housing, said locking holder being adapted for first step engagement and second step engagement with said insulator housing:

first secondary lock means formed in said terminal; and second secondary lock means formed in said locking holder; said first secondary lock means and said second secondary lock means being in registry with each other in a lateral direction in the first step engagement of the locking holder with said insulator housing only when said terminal is fully inserted into said receiving chamber of the insulator housing, whereby said locking holder is allowed to move laterally within said substantially elongated receiving chamber into said second step engagement with said insulator housing to provide a secondary lock between said insulator housing and said terminal by means of said first and second secondary lock means.

2. A double lock engagement structure according to claim 1, wherein said primary lock providing means includes an opening formed in a base portion of said terminal and a flexible arm formed in said receiving chamber and having a projection to be received in said opening in the terminal base portion.

3. A double lock engagement structure according to claim 1, wherein said first secondary lock means includes a stopper projection struck out of said base portion of the terminal whereas said second secondary lock means includes at least one bar extending axially from a base of the locking holder into said insulator housing and a stopper groove formed in said bar, said stopper projection being adapted to be received in said stopper groove.

4. A double lock engagement structure according to claim 1, wherein said insulator housing and said locking holder are formed with guide means for guiding lateral movement of said locking holder within said insulator housing in the second step engagement with the insulator housing.

5. A double engagement structure for a terminal and a connector comprising:

an elongated terminal having first and second engagement means for engaging with a connector, said elongated terminal further having a stopper projection extending in a direction perpendicular to an axis of said elongated terminal, said stopper projection providing said second engagement means; and a connector for receiving said terminal therein, said connector including an insulator housing having a through-hole receiving chamber therein, said receiving chamber having first and second opening at both ends thereof and further having a first lock element to be engaged with said first engagement means, said first opening being adapted to receive said terminal thereinto; and a locking holder to be inserted into said receiving chamber through said second opening, said locking holder having a substantially flat base and at least one bar extending from said base, said flat base having a pair of slits said bar having a second lock element to be engaged with said second engagement means, wherein said locking holder is movable along said direction such that only when said stopper projection engages with said second lock element, said first and second engagement means come into engagement with said first and second lock elements.

* * * * *